United States Patent [19]

Deeter et al.

[11] Patent Number: 4,732,224

[45] Date of Patent: Mar. 22, 1988

[54] AUGER APPARATUS

[75] Inventors: Ronald C. Deeter, Malvern; Robert J. Fisher, Columbiana, both of Ohio

[73] Assignee: The Salem Tool Company, Salem, Ohio

[21] Appl. No.: 891,508

[22] Filed: Jul. 28, 1986

[51] Int. Cl.[4] ..... E21B 19/14; E21C 1/10

[52] U.S. Cl. ..... 175/85; 212/221; 299/57; 414/22

[58] Field of Search ..... 175/85, 52; 299/56, 299/57; 414/22; 212/205, 206, 207, 208, 209, 210, 211–221

[56] References Cited

U.S. PATENT DOCUMENTS

| | | | |
|---|---|---|---|
| 3,021,963 | 2/1962 | Kasdorf et al. | 212/221 X |
| 3,281,187 | 10/1966 | Adams et al. | 175/85 X |
| 3,918,536 | 11/1975 | Deeter et al. | 414/22 X |
| 4,036,529 | 7/1977 | Hawthorne et al. | 175/91 X |

FOREIGN PATENT DOCUMENTS

| | | | |
|---|---|---|---|
| 1347135 | 11/1962 | France | 212/221 |
| 1507851 | 1/1967 | France | 212/221 |
| 220456 | 10/1968 | U.S.S.R. | 212/221 |

*Primary Examiner*—Stephen J. Novosad
*Assistant Examiner*—David J. Bagnell
*Attorney, Agent, or Firm*—Jones, Day, Reavis & Pogue

[57] ABSTRACT

Auger apparatus is disclosed adapted to utilize one or more augers each formed of a string of auger sections. The apparatus includes means for hoisting one or a plurality of auger sections simultaneously between a storage rack and a position for placement in an auger string. The hoist means includes bridge rails extending transversely of and above the machine, a trolley that travels on the bridge rails, lifting apparatus including a cable on the trolley and a carriage supported by the lifting apparatus and carrying a plurality of tongs for grasping auger sections. A safety connection is provided between the carriage and the lifting apparatus to prevent inadvertant release of a raised auger section. A collapsible and expandable assembly of multiple pairs of cross links pivotally joined at their midpoints is connected between the trolley and the tong carriage at two sides thereof to guide and stabilize the tong carriage and auger sections as they are moved. The auger apparatus also includes an opening extending transversely of the longitudinal axis of the augers for receiving a cross conveyor which receives extracted coal from the auger sections and moves it laterally to a side of the apparatus. The opening is provided with a bottom plate welded to the frame of the apparatus for supporting the cross conveyor and making the frame stronger and more rigid. The cross conveyor is connected to the bottom plate only at laterally outer portions of the plate.

11 Claims, 9 Drawing Figures

AUGER APPARATUS

BACKGROUND OF THE INVENTION

This invention relates to auger apparatus of the type that bores one or more deep holes by an auger formed of a string of connected auger sections, and more particularly to such auger apparatus that is more compact, requires less operating room and is more easily transported than prior auger apparatus.

The invention provides substantial advantages when employed in auger mining machines of the type adapted to be positioned adjacent an upwardly extending wall to recover coal from a seam exposed in such wall and which extends generally laterally into the earth. Auger mining machines of this type comprise one or more augers each embodying a cutting head of relatively large diameter connected to and rotationaly driven by a string of helically vaned auger suctions driven from the machine. The cutting head penetrates the coal seam and the separated coal is transported rearwardly from the cutting head along the vaned auger string to the entrance of the hole made by the cutting head where the coal is collected and removed. Typically, the coal is delivered from the vaned auger string to a cross conveyor mounted across the front of the auger apparatus which transports the coal laterally to another conveyor for removal to a truck or other conveyance. The cross conveyor usually carries an integral heavy mounting plate extending across its bottom. The conveyor is mounted on the auger apparatus by a series of spaced bolts or pins extending the length of the plate.

As the cutting head penetrates into the seam, it is necessary to introduce additional auger sections into the string until the desired length of the auger string is reached to achieve the desired depth of hole. In order to achieve desired high production, it is necessary to handle the auger sections rapidly and accurately in taking them from a store of sections and placing them in the auger string and in removing them from the auger string and replacing them in the store of sections. It is desired that the sections be rapidly lifted and put in place accurately in the auger string. Because of the size and weight of the auger sections, they must be handled by mechanical hoist means.

Auger apparatus that has proven to be very efficient and very effective in operation is described in U.S. Pat. No. 3,918,536 assigned to the Assignee of the present invention. Recently, however, there has developed a need for auger apparatus to mine previously worked areas having limited amounts of coal remaining to be extracted and which offer substantially less room for operation. Such use requires apparatus that may be placed on a truck and moved readily over any number and type of roads in order to extract coal efficiently at a plurality of sites in a relatively short time. The height, as well as the size and weight, of the auger apparatus on the truck is an important factor in the ability to move the apparatus efficiently from site to site.

SUMMARY OF THE INVENTION

It is a general object of this invention to provide auger apparatus having desired characteristics for effecient movement from and to a number of mining sites in a relatively short time.

It is a more particular object of the invention to provide auger apparatus that is compact, more easily transported and much lower in height than prior auger apparatus.

According to one aspect of the invention there is provided auger apparatus including auger section hoist means which occupies substantially less vertical height than prior hoist means of similar capabilities. Hoist means according to the present invention for lifting and lowering an auger section includes a laterally movable member and means for supporting the laterally movable member for lateral movement between a location above an auger in operational position in the apparatus and a location spaced laterally therefrom. A lift means is carried by the laterally movable member and an auger section holding means is connected to the lift means. Means is provided between the laterally movable member and the auger section holding means to guide and stabilize the auger section holding means.

Preferably, the lifting means includes a flexible cable and the guide means includes at least one set of cross links connected pivotally at their midpoints and at opposite ends to the auger section holding means and the laterally movable member. The cross links form a collapsible and extendible multiple scissor arrangement.

According to another aspect of the invention a safety connection is provided between the lift means and the auger section holding means which prevents auger sections from being released when they are in a raised position.

According to still another aspect of the present invention the frame of the auger apparatus is provided with a laterally extending bottom plate fastened integrally thereto, as by welding, and means defining a lateral opening above the plate for receiving a cross conveyor. The plate strengthens the frame of the auger apparatus and provides a support for receiving the cross conveyor for connection thereto. The cross conveyor may be inserted into the receiving opening and onto the support plate from either side of the auger apparatus for conveying coal in either lateral direction. The conveyor is connected to the plate only at the laterally outer portions of the plate and may be connected and disconnected quickly and easily. The cross conveyor is lighter in weight and more easily moved, installed and handled than prior cross conveyors which included an integral support plate.

DESCRIPTION OF A PREFERRED EMBODIMENT

Figure 1:
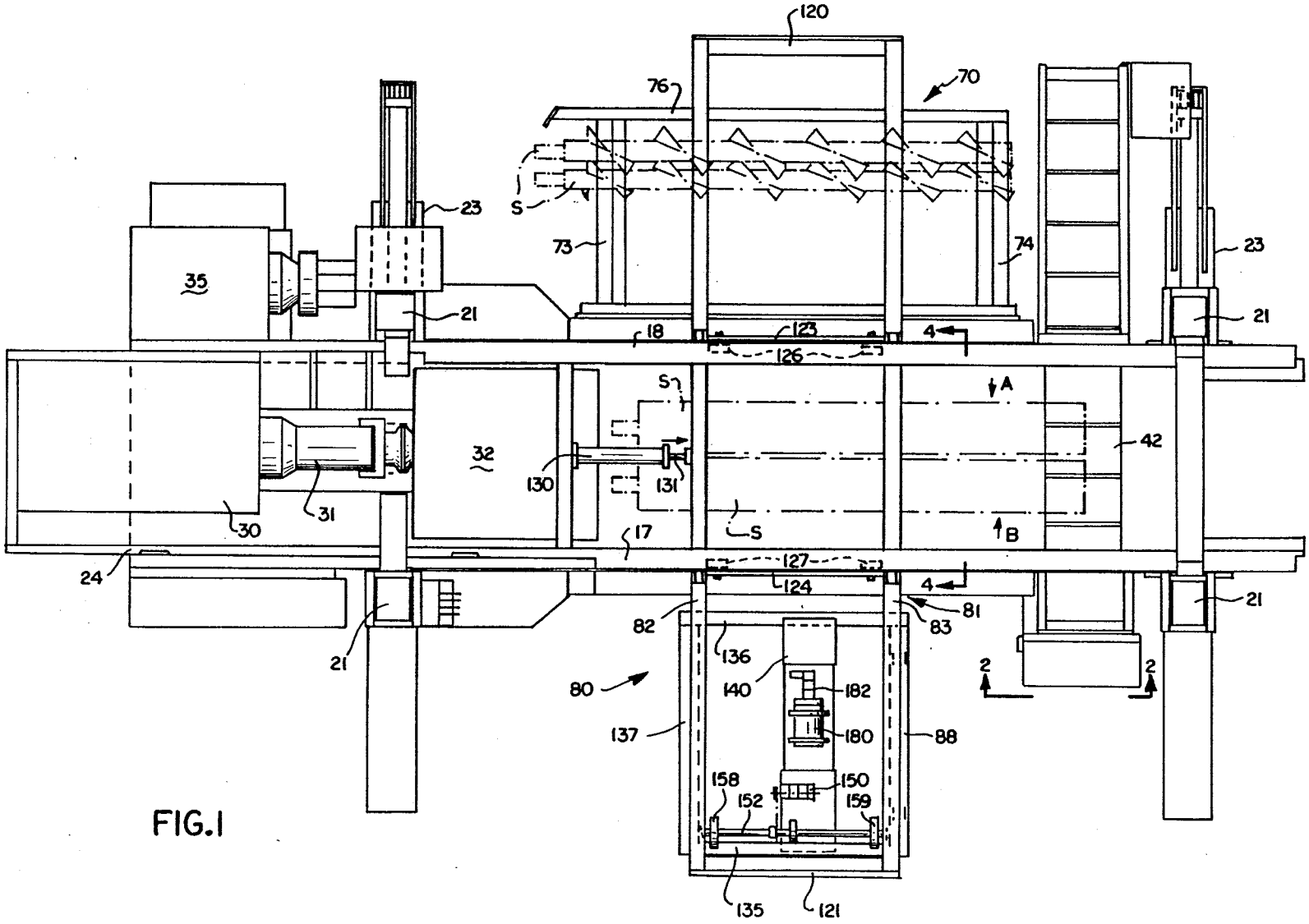
FIG. 1 is a plan view of auger apparatus embodying the present invention, certain nonessential elements having been left out for the sake of clarity.

The auger machine of FIGS. 1 to 9 comprises a rigid main frame 10 from which two augers A, B are supported and driven. In use, the augers are detachably connected at their outer ends to a cutting head assembly (not shown) and are made up of strings of connected identical auger sections S. Main frame 10 comprises a pair of spaced longitudinally extending parallel bottom beams 13, 14 (FIG. 4) and a pair of spaced longitudinally extending top beams 17, 18. The main frame includes four vertical jacks 21 for raising and lowering the frame to position the augers at the required height. The auger machine also includes a skid assembly 23 of known construction. By suitable manipulation of the jacks and skids in known manners, it is possible to move the machine laterally or closer to or further from the wall into which the augers penetrate, as desired.

Frame 10 also supports a carriage 24 which moves longitudinally on beams 13, 14 to advance augers A and B for cutting and to retract them for removal of auger sections. The carriage is retracted without the augers for insertion of additional auger sections.

A power source 30 such as an internal combustion engine for rotating the augers is fixed on carriage frame 24 and drives the augers through a conventional transmission 31 and associated power train components indicated generally by box 32. The apparatus also includes auxiliary power means 35, such as an internal combustion engine and appurtenant apparatus, for producing auxiliary power such as pumped hydraulic fluid under pressure which is controlled through known means to actuate various other portions of the apparatus.

Coal mined by the cutting heads and augers passes on to a cross conveyor 42 which transports the coal laterally to one or the other side of the machine for removal, as by another conveyor and a truck or other conveyance (not shown).

Figure 3:
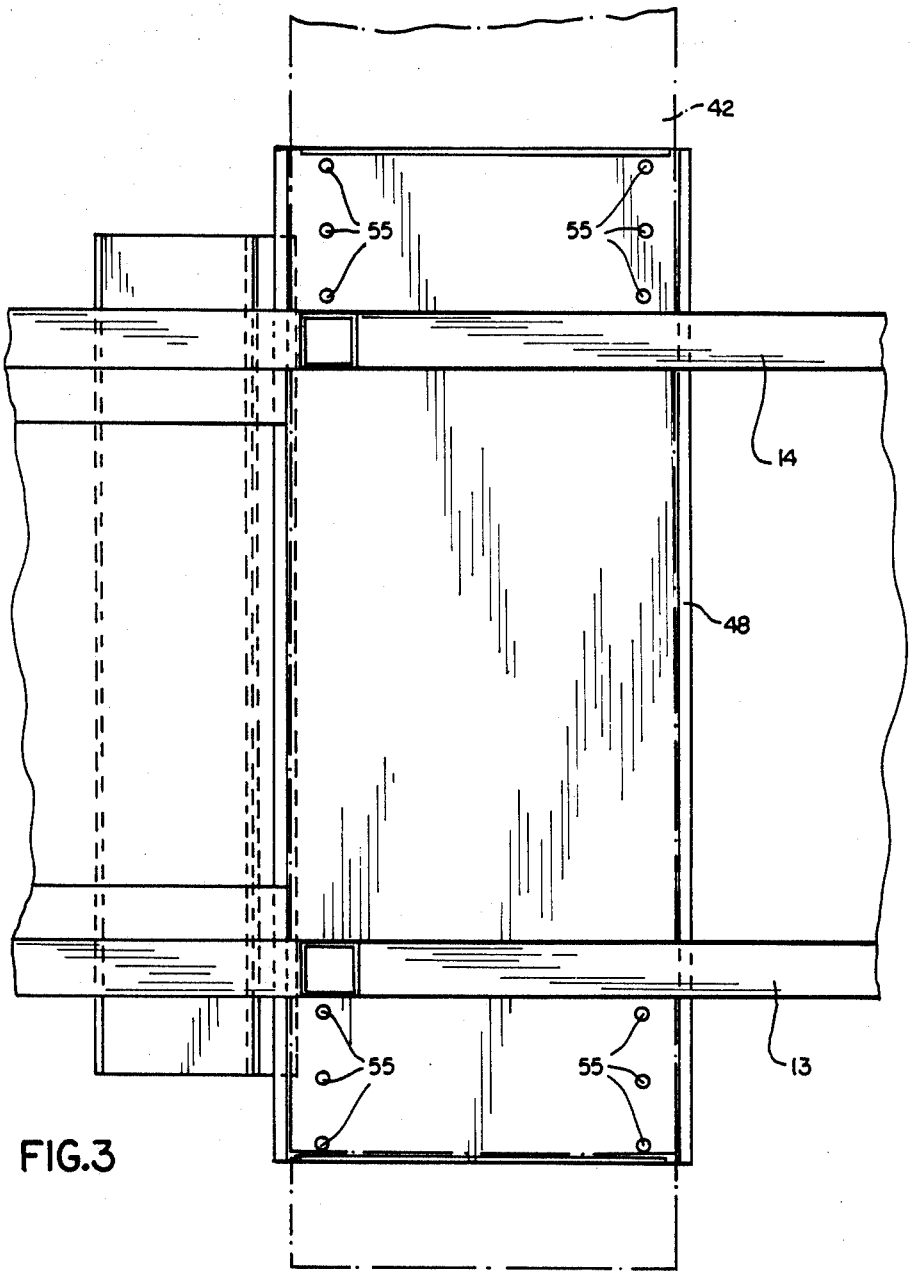
FIG. 3 is a plan view in the direction of the arrows 3—3 of FIG. 2 showing the cross conveyor opening and mounting arrangement in the auger machine.
Figure 2:
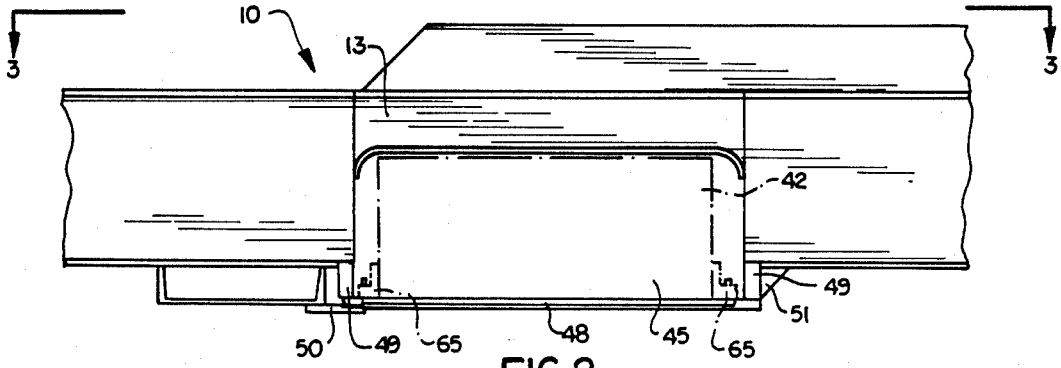
FIG. 2 is an elevational view in the direction of the arrows 2—2 of FIG. 1 of the cross conveyor opening in the auger machine.
Figure 4:
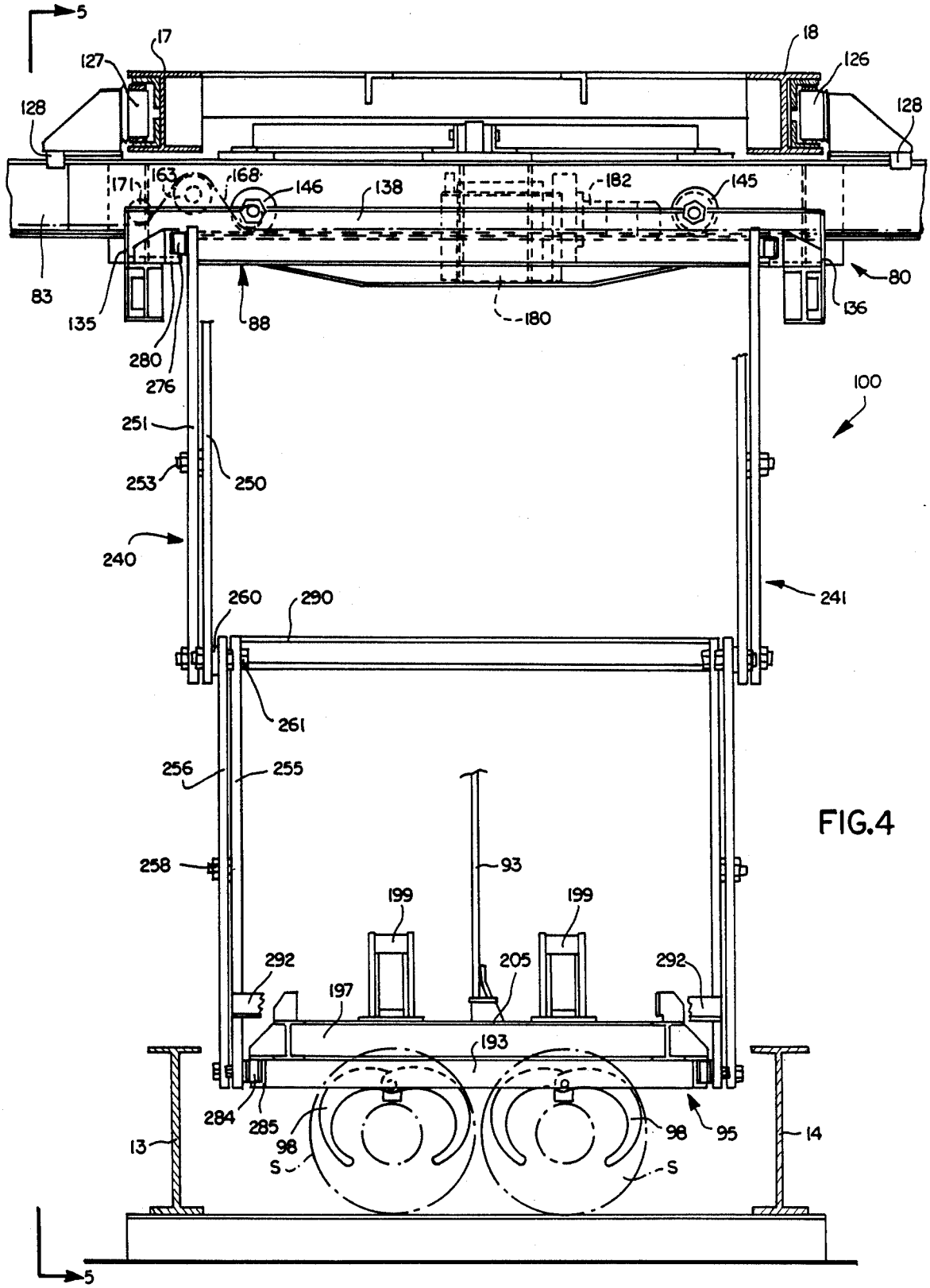
FIG. 4 is an elevational view along the lines 4—4 of FIG. 1 with the trolley moved from the position of FIG. 1 to the center position.
Figure 5:
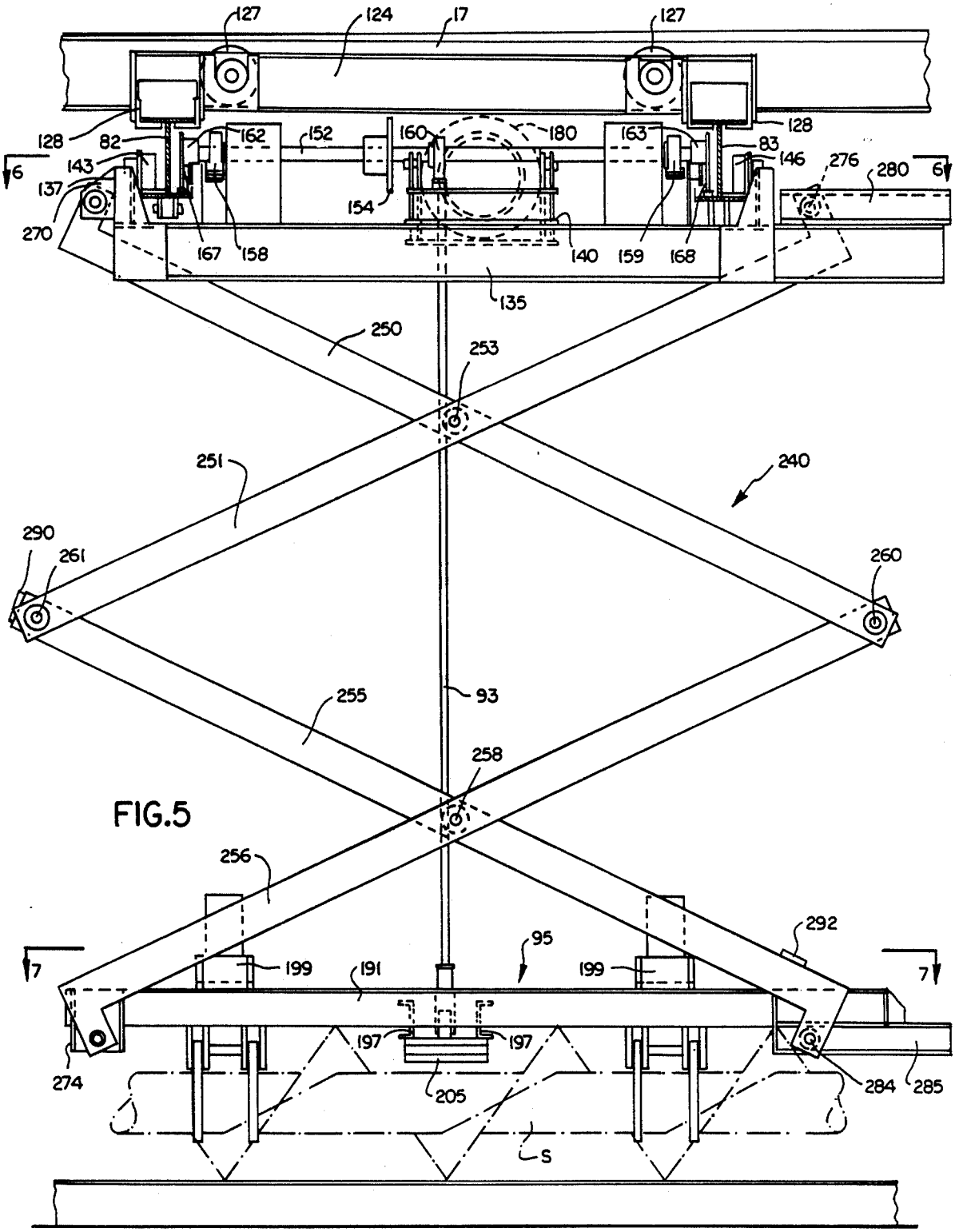
FIG. 5 is an elevational view in the direction of the arrows 5—5 of FIG. 4.
Figure 6:
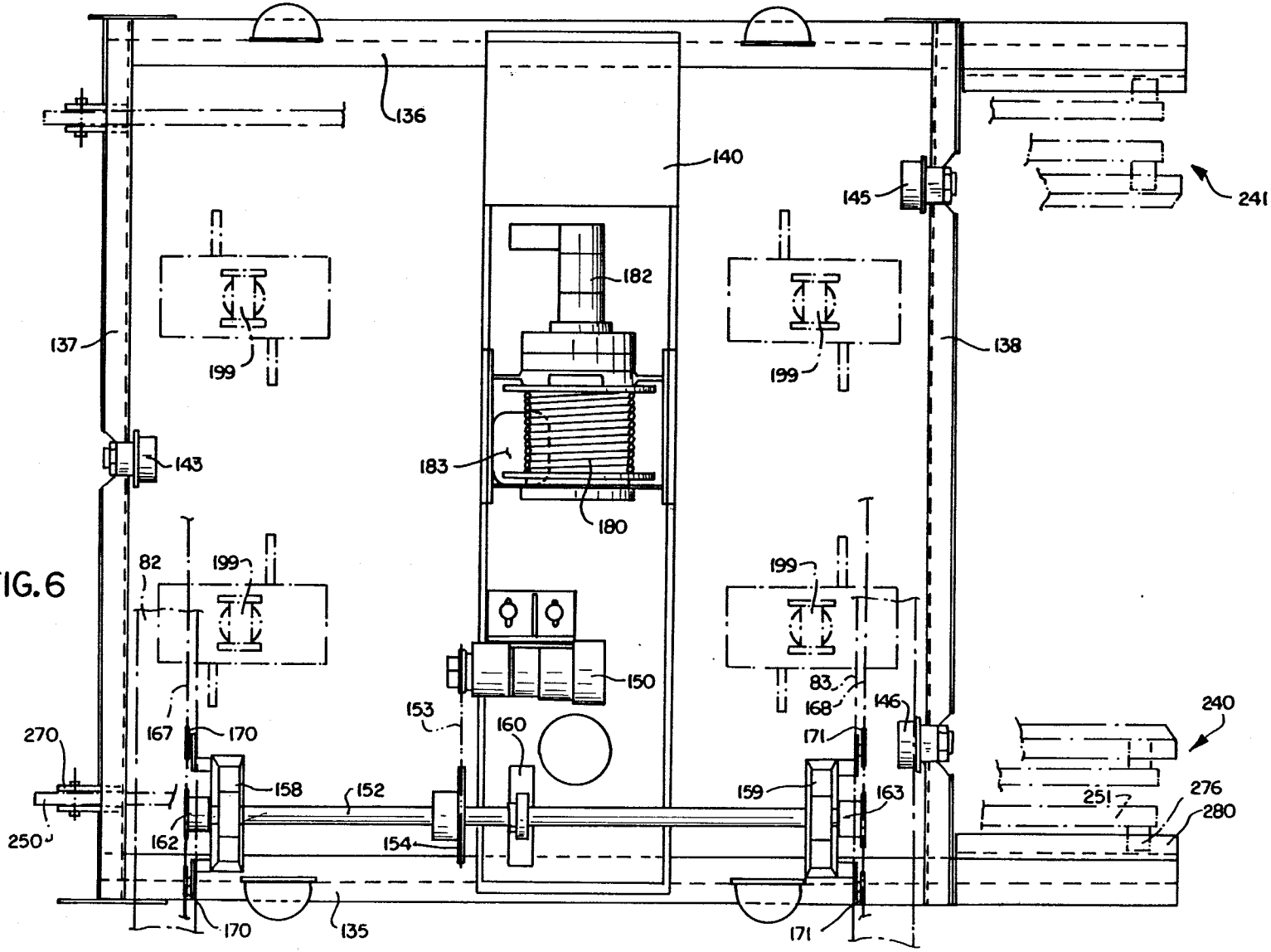
FIG. 6 is a plan view of the trolley in the direction of the arrows 6—6 of FIG. 5.
Figure 7:
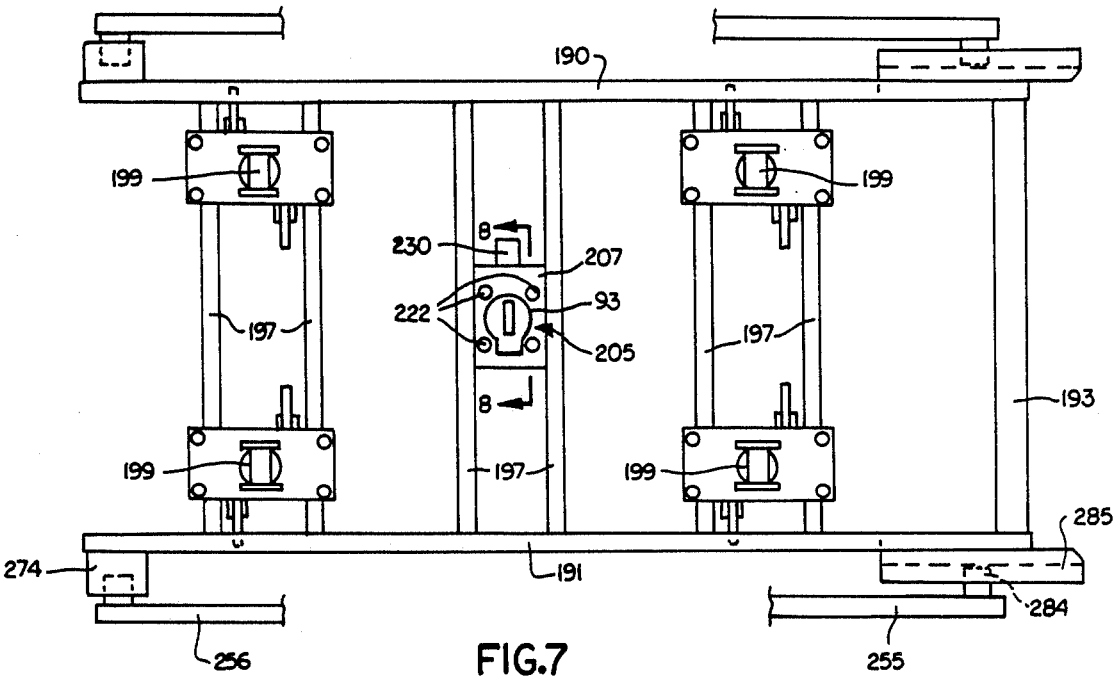
FIG. 7 is a plan view of the tong carriage in the direction of the arrows 7—7 of FIG. 5.

As shown in FIGS. 2 and 3, conveyor 42 fits within an opening 45 in frame 10 behind front jacks 21 and is supported by a rigid steel plate 48 which extends transversely across frame 10. Plate 48 has upright side flanges 49 and is welded to frame members 50 and 51. Plate 48 serves not only to support conveyor 42 but also to strengthen frame 10. Front jacks 21 are located well forward in the frame 10 so that a substantial length of beams 13, 14 extends between the front and rear jacks 21. Material removed from beams 13, 14 to define opening 45 also reduces the strength of the beam. The provision of plate 48 therefore adds needed strength and rigidity to frame 10. Conveyor 42 may be placed in opening 45 on plate 48 in either lateral direction for delivering coal to either side of the auger machine. Conveyor 42 is fastened to plate 48 by means of bolts and nuts extending through a set of openings 55 at the laterally outer ends of plate 48 and a corresponding set of openings in flange plates 65 on the bottom of conveyor 42. Conveyor 42, in itself, is well known and need not be described in detail.

In prior auger apparatus, a plate similar to plate 48 was welded or otherwise integrally attached to a cross conveyor such as conveyor 42 and the plate bolted to frame portions of an auger machine at closely spaced locations across the entire lateral width of the frame. In the present apparatus, plate 48 is provided as an integral part of frame 10 to support conveyor 42 and to strengthen frame 10. The conveyor is fastened to plate 48 only at the laterally outer portions of plate 48. Conveyor 42 is thus lighter in weight and easier to handle, install and remove than similar conveyors in prior auger machines, while, at the same time, frame 10 is strengthened by the addition of plate 48.

The machine of FIGS. 1 to 9 rotates the auger cutting heads by rotation of the two augers A and B. As the cutting heads are rotated and penetrate the coal or other material being mined by movement of carriage 24, auger sections S from auger storage racks 70 are inserted into the string to extend the lengths of the augers as required as the holes are bored deeper by the cutters.

Auger storage rack 70 includes a pair of side beams 73, 74 extending laterally from the auger machine and connected together at their outer ends by cross beam 76. Rack 70 may be installed on the opposite side of the machine from that shown in FIG. 1 or racks may be provided on both sides of the machine if desired.

A hoist apparatus 80 for handling auger sections is supported from top beams 17 and 18 of the main frame 10. This apparatus comprises a bridge 81 having two spaced parallel rails 82, 83 extending transversely of the auger machine over the auger storage rack 70 and over the central portion of the apparatus at which are located augers A and B. A trolley 88 is adapted to travel on bridge 81 along rails 82, 83. Trolley 88 carries a lift mechanism including a cable 93 connected to a tong carriage 95 that is movable by cable 93 upwardly and downwardly relative to trolley 88. Tong carriage 95 carries tongs 98 adapted to grasp simultaneously a pair of auger sections S and move them between the storage rack 70 and desired positions in the central portion of the machine for connection with other auger sections. A guiding and stabilizing structure 100 is connected at one end to trolley 88 and at its other end to tong carriage 95 and collapses and expands as tong carriage 95 moves upwardly and downwardly to guide and stabilize carriage 95 and auger sections S.

Bridge 81 includes, in addition to cross beams 82, 83, end members 120, 121 connecting the two beams to form a rectangular structure. Beams 82, 83 are connected to main top beams 17, 18 for limited movement longitudinally thereof by another pair of cross members 123, 124 each carrying a pair of roller assemblies 126, 127, respectively, which travel along top beams 17, 18. Cross members 123, 124 are connected to beams 82, 83 by brackets 128. A hydraulic cylinder 130 (FIG. 1) carrying a piston 131 connected to beam 82 provides motive power for extending and retracting bridge 81.

Trolley 88 comprises two beams 135, 136 joined by cross members 137, 138 and supporting a cross frame 140. Cross member 137 carries a single roller 143 located midway between beams 135 and 136 and riding on rail 82. Cross member 138 carries two rollers 145, 146 which ride rail 83. The trolley is thus supported at three points on the beams 82, 83 and is stable. Trolley 88 is moved in either direction as required along rails 82, 83 by a fluid power motor 150 mounted on frame 140 which drives a shaft 152 through a chain 153 and sprocket 154. Shaft 152 is rotatably carried by bearing brackets 158, 159 and supported in a bracket 160 mounted on frame 140. Shaft 152 carries a drive sprocket 162, 163 at each end. Each rail beam 82, 83 of bridge 81 supports a chain 167, 168 fixed at its ends to secure the chain against longitudinal movement. Each chain extends around and between idler sprockets 170, 171 and over the drive sprockets 162, 163 carried at the ends of shaft 152. Consequently, as shaft 152 is rotated in the appropriate direction by fluid motor 150, the trolley is moved in the desired direction by engagement of sprockets 162, 163 with chains 167, 168 on rails 82, 83, respectively.

Cross frame 140 on trolley 88 carries, in addition to fluid motor 150 for propelling trolley 88, a winch 180 driven by a fluid motor 182. Winch 180 raises and lowers cable 93 which extends through an opening 183 in frame 140 and is connected to tong carriage 95.

Tong carriage 95 includes a pair of longitudinally extending side rails 190, 191, on end rail 193 at the front of the tong carriage joining side rails 190, 191 and a plurality of bridging rails 197. Two hydraulic operating cylinders 199 for tongs 98 are supported on each of the front and back pairs of bridging rails 197. The center pair of bridging rails 197 supports a safety connection assembly 205 for connecting cable 93 to the tong carriage.

Figure 8:
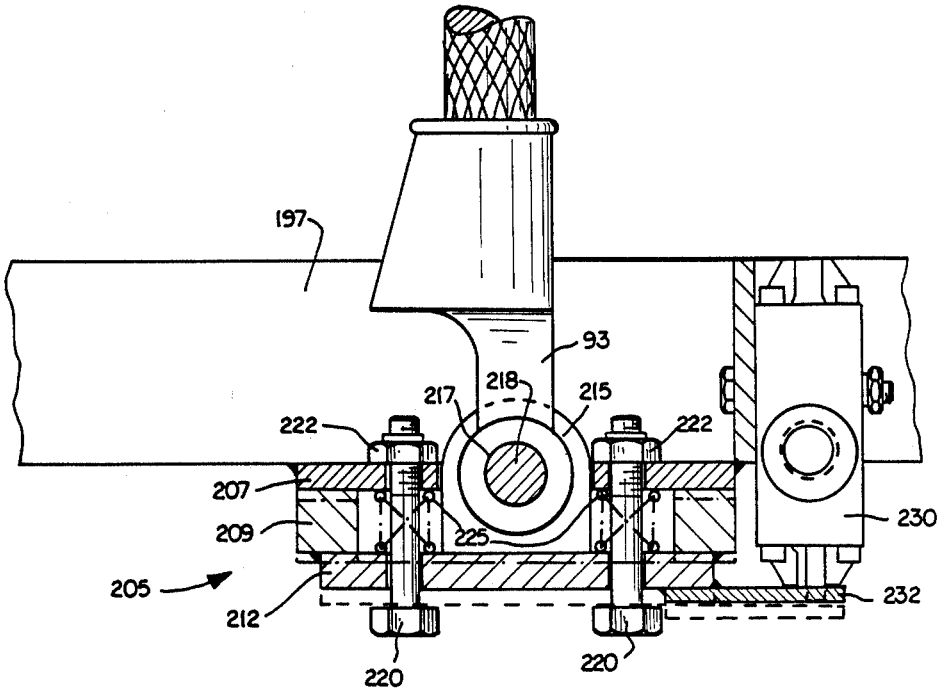
FIG. 8 is a sectional view along the line 8—8 of FIG. 7 showing the safety connection of the lifting cable to the tong carriage.

Cable 93 is connected to tong carriage 95 by safety assembly 205 as shown in FIG. 8. Safety assembly 205 includes a plate 207 positioned between and welded to the bottoms of the two central bridging rails 197. A spacer 209 separates a bottom plate 212 from plate 207. A mounting bracket 215 is welded or otherwise connected to bottom plate 212 and contains an opening 217 for receiving a pin 218 to fasten cable 93 to assembly 205. Four bolts 220 (only two being shown) pass through openings in plates 207 and 212 and are fastened therein by nuts 222. Four springs 225 (only two being shown) positioned between plates 207 and 212 bias the plates apart to the extent permitted by the lengths of bolts 220 when no or only slight pressure is exerted upwardly by cable 93 on plate 212. A normally open hydraulic valve 230 is connected in the assembly 205 in such a way that it remains unoperated so long as plates 207 and 212 are biased apart by springs 225. When, however, upward force is exerted by cable 93 on plate 212 to lift the tong carriage, valve 230 is operated to the closed position (shown in FIG. 8) by a small plate 232 welded to the bottom of plate 212. The closing of valve 230 prevents the operator from opening tongs 98 to release an auger section carried thereby when tong carriage 95 is raised, as will be explained more fully below.

According to an important aspect of this invention, tong carriage 95 is guided and stabilized by means 100 as the carriage is raised and lowered and moved laterally and longitudinally. This ensures that auger sections S carried by tongs 98 will remain stable and in the proper positions during movement between storage rack 70 and the auger string in the machine. This guiding and stabilization is achieved by multiple sets of cross links forming a multiple scissor arrangement connected between each side rail 190, 191 of tong carriage 95 and frame members 137 and 138 of trolley 88. As shown best in FIGS. 4 and 5, two cross link assemblies 240, 241 are provided, one at each side of tong carriage 95. Assembly 240 includes a first pair of cross links 250, 251 joined pivotally at their centers by a pin 253 and a second pair of cross links 255, 256 similarly pivotally joined at their centers by pin 258. The lower ends of links 250, 251 are connected pivotally to the upper ends of links 256, 255, respectively, by pins 260, 261.

The upper end of link 250 has a short right-angled extension and is pinned pivotally to a bracket 270 mounted on cross member 137 of trolley 88. The lower end of link 256 is pinned pivotally to a bracket 274 mounted on side member 191 of tong carriage 95. The upper end of link 251 is pivotally fixed to a roller assembly 276, the roller of which rolls horizontally in a channel 280 in a rail welded or otherwise suitably fastened to member 135 of trolley 88. Similarly, the lower end of link 255 is pivotally fixed to a roller assembly 284, the roller of which can roll horizontally in a channel 285 formed in a rail member affixed to side rail 191 of tong carriage 95.

Cross link assembly 241 connected between the other side rail 190 of tong carriage 95 and member 136 of trolley 88 is identical in structure and connected to tong carriage 95 and trolley 88 in the same way and need not be described. The two cross link assemblies 240, 241 are connected together at the junction of cross links 251 and 255 and the corresponding junction in assembly 241 by a cross member 290 extending between the junctions. A second cross member 292 is connected between the lower end of cross link 255 and the corresponding cross link in assembly 241.

Cross link assemblies 240 and 241 guide and stabilize tong carriage 95, and, consequently, auger sections S carried by tongs 98, as the tong carriage is raised, lowered and moved about. The tong carriage is maintained in a substantially horizontal plane as the assemblies 240, 241 expand and collapse. Tong carriage 95 is stabilized to permit faster raising and lowering as well as lateral and longitudinal movement of the carriage while maintaining the stability and proper orientation of auger sections S carried by tongs 98. The movement of roller assemblies 276 and 284 in the channels 280 and 285 accommodates the changes in horizontal component of the length of the links as the assemblies are collapsed and expanded.

It will be noted that the hoist apparatus requires no component extending significantly above trolley 88. The difference in vertical length of lift cable 93 and stabilizing assemblies 240, 241 from the lowered to the raised position of the auger sections is stored within the units themselves and not by vertical extension above trolley 88. This allows the auger apparatus to be much lower in height than prior apparatus of the same general capabilities.

Figure 9:
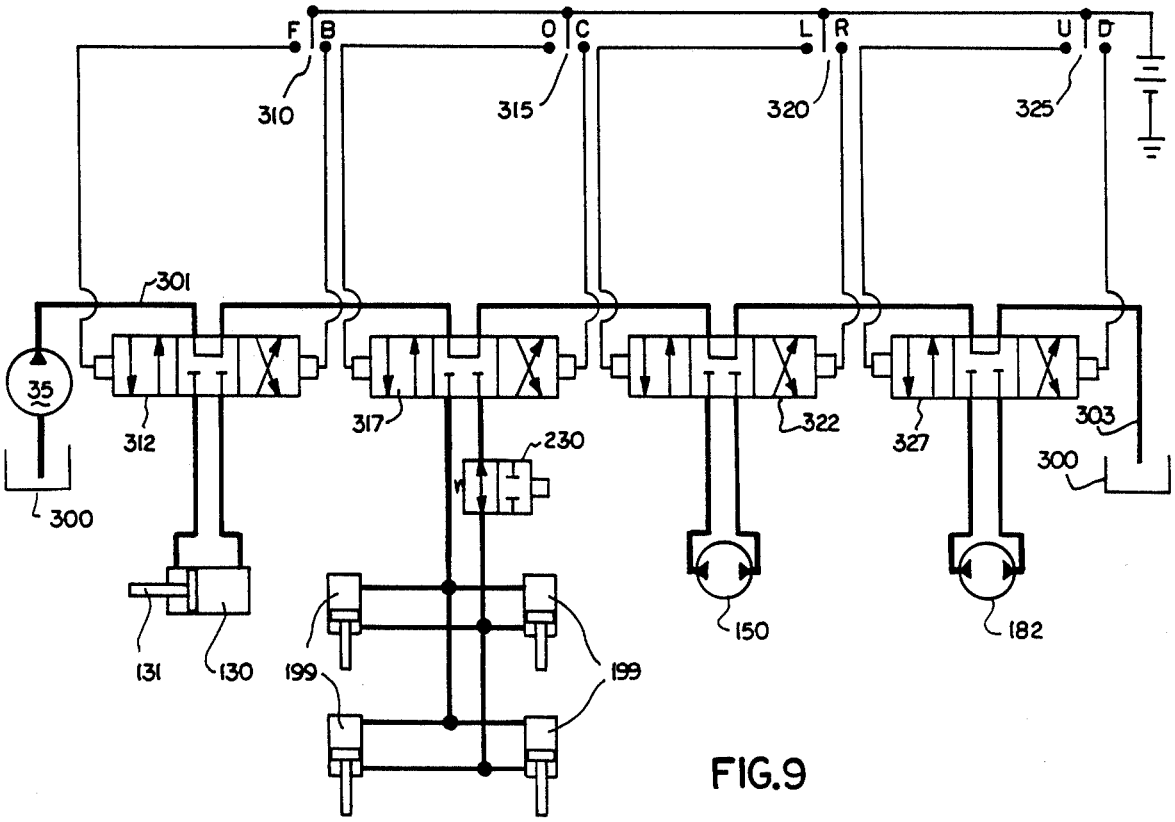
FIG. 9 is a schematic diagram of the hydraulic circuits for operating the hoist apparatus of the auger machine.

The hydraulic control circuits for the hoist apparatus are shown in FIG. 9. As shown there, power fluid under pressure is supplied by auxiliary power means 35 from a suitable source 300 through line 301 and is returned thereto through line 303. The power fluid is supplied to a plurality of conventional solenoid operated 4-way hydraulic control valves controlled by the position of a set of electrical switches. An operator positions the switches to advance and retract bridge 81, open and close tongs 98, move trolley 88 laterally across the auger machine and operate winch 180 to lift and lower cable 93 and tong carriage 95.

Bridge 81 is moved forward or back by positioning switch 310 to the desired indicated position which operates solenoid controlled valve 312. Power fluid is routed by the valve to bridge hydraulic cylinder 130 on the appropriate side of piston 131 to move the bridge forward or back as desired.

Tongs 98 are opened or closed by operating switch 315 to the desired position to operate solenoid controlled valve 317 which routes power fluid to tong cylinders 199 in the appropriate direction to close or open them, as desired. As described briefly above, normally open hydraulic safety valve 230 is positioned in the line through which fluid is supplied from valve 317 to tong cylinders 199. So long as tong carriage 95 is not raised valve 230 remains open and tongs 98 can be opened or closed by power fluid provided in the appropriate direction to tong cylinders 199. When, however, tong carriage 195 is raised valve 230 will be closed and prevent the flow of power fluid to or from tong cylinders 199. This prevents the operator from being able to inadvertantly open tongs 98 when the tong carriage is in a raised position. Thus, an auger section cannot be dropped by the inadvertant operation of switch 315 to the "open tongs" position.

Trolley 88 is moved laterally to the left or right by operating switch 320 to the desired position. This operates solenoid controlled valve 322 and provides power fluid to trolley motor 150 to rotate it in the appropriate direction for the desired direction of trolley movement.

Tong carriage 95 is raised or lowered by operating switch 325 to the desired position. This causes solenoid controlled valve 327 to direct fluid to winch motor 182 to rotate it in the appropriate direction for the desired action.

We claim:

1. Auger apparatus comprising a frame, means associated with said frame for rotating at least one auger in said apparatus made up of a plurality of elongated auger sections connected end-to-end along a longitudinal axis, storage means on said apparatus spaced laterally from an auger in said apparatus for storing a plurality of auger sections in parallel relationship to said longitudinal axis, hoist means assocaited with said frame for lifting and lowering an auger section and moving same between said storage means and an auger in said apparatus, said hoist means comprising a laterally movable member, means for supporting said laterally movable member for lateral movement between a location above an auger in said apparatus and a location above said storage means, lift, means carried by said laterally movable member and including carriage means having auger section holding means thereon, said carriage means having spaced-apart opposite side rails extending parallel to said longitudinal axis, collapsible and expandable guide means connected between said laterally movable member and each said side rail on said carriage means to guide said carriage means in an upwardly extending path of movement when lifted by said lift means and for stabilizing said carriage means during movement of said laterally movable member, said frame including overhead frame means for supporting said hoist means, said hoist means being suspended beneath said overhead frame means with no components of said hoist means extending above said overhead frame means in any position of said hoist means.

2. Apparatus as claimed in claim 1 wherein said guide means includes at least one set of cross links connected pivotally at their midpoints and at opposite ends to said auger section holding means and said laterally movable member.

3. Apparatus as claimed in claim 2 including means connecting an end of one link to said auger section holding means to permit translational movement of said end relative to said auger section holding means, and means connecting an end of another link to said laterally movable member to permit translational movement of said end of said another link relative to said laterally movable member.

4. Apparatus as claimed in claim 1 including bridge means for supporting said laterally movable member, said bridge means being suspended beneath said overhead frame means for movement parallel to said longitudinal axis and having no components thereof extending above said overhead frame means.

5. The apparatus of claim 1 including power means carried by said laterally movable member for moving same between said locations.

6. The apparatus of claim 5 wherein said power means includes a motor drivingly connected to a rotatable shaft having at least one sprocket engaging a chain which is secured against longitudinal movement to said means for supporting said laterally movable member.

7. The apparatus of claim 1 wherein said hoist means includes a flexible member for lifting and lowering said carriage, means, and means responsive to lifting force on said carriage by said flexible member for preventing release of an auger section carried by said auger section holding means.

8. Apparatus as claimed in claim 7 wherein said auger section release preventing means includes a control member for preventing actuation of said auger section holding means when operated, operating means for said control member connected to said carriage and to said flexible member, and means biasing said operating means to a position in which said control member is not operated when less than a predetermined force is exerted on said operating means by said flexible member, said control member being opeated by said operating means when the force exerted by said flexible member on said opeating means is greater than said predetermined force, whereby said control member prevents actuation of said auger section holding means to release an auger section when said carriage is lifted.

9. The apparatus of claim 1 including a cross conveyor positioned below said longitudinal axis and extending transversely thereof for carrying material away from an auger in said apparatus.

10. The apparatus of claim 9 wherein said frame includes bottom frame members extending parallel to said longitudinal axis, an opening in at least one of said bottom frame members, a bottom plate spanning said opening, said cross conveyor being received through said opening and being supported on said bottom plate.

11. The apparatus of claim 10 including means connecting said cross conveyor to said bottom plate only at the laterally outer portions of said bottom plate.

* * * * *